US008763798B2

(12) United States Patent
Paul

(10) Patent No.: US 8,763,798 B2
(45) Date of Patent: Jul. 1, 2014

(54) CLOSURE FOR FILLING AND SEALING RECEPTACLES CONTAINING MEDICINAL FLUIDS AND METHOD FOR FILLING A RECEPTACLE WITH A MEDICINAL FLUID AND SEALING THE RECEPTACLE

(75) Inventor: Michael Paul, Eppelborn (DE)

(73) Assignee: Fresenius Medical Care Deutschland GmbH, Bad Homburg (DE)

( * ) Notice: Subject to any disclaimer, the term of this patent is extended or adjusted under 35 U.S.C. 154(b) by 527 days.

(21) Appl. No.: 12/524,012

(22) PCT Filed: Jan. 22, 2008

(86) PCT No.: PCT/EP2008/000446

§ 371 (c)(1),
(2), (4) Date: Aug. 18, 2009

(87) PCT Pub. No.: WO2008/089948

PCT Pub. Date: Jul. 31, 2008

(65) Prior Publication Data

US 2009/0314781 A1 Dec. 24, 2009

(30) Foreign Application Priority Data

Jan. 25, 2007 (DE) ..... 10 2007 003 835

(51) Int. Cl.
*B65D 25/08* (2006.01)

(52) U.S. Cl.
USPC ..... 206/221; 604/256; 604/416; 604/89; 220/212

(58) Field of Classification Search
USPC ..... 206/219, 221, 220; 215/DIG. 8; 604/256, 257, 408, 410, 416, 89, 91; 220/212, 253, 281, 284
See application file for complete search history.

(56) References Cited

U.S. PATENT DOCUMENTS 3,467,097 A * 9/1969 Ogle ..... 206/221
4,494,363 A 1/1985 Rica et al.

(Continued)

FOREIGN PATENT DOCUMENTS

CA 2384279 A1 3/2001
CA 2384347 A1 3/2001

(Continued)

OTHER PUBLICATIONS

International Search Report, PCT/EP2008/000446, mailed Sep. 16, 2008.

(Continued)

*Primary Examiner* — Jacob K Ackun
(74) *Attorney, Agent, or Firm* — Kenyon and Kenyon LLP

(57) ABSTRACT

The present invention relates to a closure for filling and sealing receptacles containing medicinal fluids, a method for filling a receptacle with a medicinal fluid and sealing the receptacle. The closure used in the method comprises a mounting piece that may be attached to the receptacle and a connector piece that may be connected to a connector piece of a filling device. A closure body is arranged between the mounting piece and the connector piece, in which a closure piece for sealing the closure sits. The closure piece may be slid between a position sealing the closure and a position which opens the closure. The closure is sealed tight with a removable protective cap. The present method is characterized in that with the protective cap removed the receptacle is filled through the closure in a clean room, whereupon after filling, the closure is sealed by pressing the closure piece into the closure.

16 Claims, 6 Drawing Sheets

(56) References Cited

U.S. PATENT DOCUMENTS

| | | | | |
|---|---|---|---|---|
| 4,722,727 | A | 2/1988 | Ogden et al. | |
| 5,015,374 | A | 5/1991 | Mathieu et al. | |
| 5,405,001 | A * | 4/1995 | Lillard | 206/221 |
| 6,113,257 | A * | 9/2000 | Sharon et al. | 366/130 |
| 6,230,472 | B1 | 5/2001 | Stahlecker et al. | |
| 6,581,906 | B2 | 6/2003 | Pott et al. | |
| 2003/0105448 | A1 | 6/2003 | Shiraishi et al. | |
| 2003/0158537 | A1 | 8/2003 | Shiraishi et al. | |
| 2005/0075613 | A1 | 4/2005 | Hasegawa | |

FOREIGN PATENT DOCUMENTS

| | | | |
|---|---|---|---|
| DE | 19806520 | A1 | 8/1999 |
| DE | 10011724 | C1 | 4/2001 |
| EP | 0352540 | A2 | 1/1990 |
| EP | 1132107 | A2 | 9/2001 |
| EP | 1230144 | B1 | 8/2002 |
| EP | 1369170 | A | 12/2003 |
| EP | 1514835 | A1 | 3/2005 |
| JP | 59-129746 | | 8/1984 |
| JP | 62-38846 | | 3/1987 |
| JP | 63-77890 | | 1/1990 |
| JP | 08-104345 | | 4/1996 |
| JP | 11-029163 | | 2/1999 |
| JP | 2006-288523 | | 10/2006 |
| WO | 01/17891 | A1 | 3/2001 |

OTHER PUBLICATIONS

International Preliminary Report on Patentability and Written Opinion from PCT/EP2008/000446 dated Aug. 4, 2009.

* cited by examiner

CLOSURE FOR FILLING AND SEALING RECEPTACLES CONTAINING MEDICINAL FLUIDS AND METHOD FOR FILLING A RECEPTACLE WITH A MEDICINAL FLUID AND SEALING THE RECEPTACLE

CROSS REFERENCE TO RELATED APPLICATIONS

This is a 371 national phase application of PCT/EP2008/000446 filed Jan. 22, 2008, claiming priority to German Patent Application No. 10 2007 003 835.8 filed Jan. 25, 2007.

FIELD OF INVENTION

The present invention relates to a closure for filling and closing containers containing medical liquids. Moreover, the present invention relates to a container for receiving a medical liquid with one such closure. Furthermore, the present invention relates to a method for filling a container with a medical liquid under aseptic conditions and the closing of the container.

BACKGROUND OF THE INVENTION

In the technology of filling liquid products, in particular in the medical sector, and in the drinks industry, the aseptic filling of containers is an extremely important production method. With the known methods for aseptic filling, a container to be filled is transferred into a clean room exposed to a special atmosphere and filled with the sterile or aseptically pretreated liquid. Depending on the requirements that are made on the purity of the liquids to be filled, different classes of rooms with a special atmosphere are stipulated for the filling. For the filling of medical solutions, for example, it is necessary for the filling nozzle and the container opening to be located in a clean-room class A. This clean-room class defines, according to certain conditions, a maximum permissible number of particles and germs. By definition, it is necessary for a clean room of class A to be surrounded by a clean room of class B, which permits a higher particle number per volume of atmosphere.

The known aseptic filling methods enable a largely germ-free filling of containers with liquids. In contrast with conventional sterilization methods, which are used as standard in medical technology for the sterilization of solution containers for example, the aseptic filling methods offer the advantage of obtaining liquids filled in a sufficiently germ-free manner without heat/pressure treatment. In this regard, the aseptic filling methods are superior to the standard heat sterilization. This becomes particularly clear when large-volume solution containers, for example bags with solutions for peritoneal dialysis, with a volume of several liters, are sterilized by a heat/pressure method. Long heating phases are required for this in order that the liquid present in the bags can accept the corresponding temperature. At the same time, it is necessary to build up an external high pressure acting on the bags in order that the bags do not burst due to the heat-induced internal pressure.

US Patent Publication 2005/0075613 A1 describes a port for a medical container, which has an axially displaceable closure stopper. In the event of an over-pressure building up in the container, the closure stopper is displaced, so that the over-pressure can be reduced. The removal from or filling of the bag is intended to take place by means of a needle which is pierced through the closure stopper.

There is known from EP 1 132 107 A2 a connector with a closure element which serves as a connection piece for transfer systems. The known connector is not intended for the filling of containers. Flow-through openings are freed when the closure element is displaced.

U.S. Pat. No. 4,722,727 describes a port for a bag, which has a closure body with a closure stopper, said closure body extending into the bag interior. For the removal of the liquid, the closure stopper located in the bag interior is pulled out of the closure body. For this purpose, it is necessary to act manually on the closure stopper from the bag exterior through the bag wall.

There is known from U.S. Pat. No. 4,494,363 a device and a method for the aseptic filling of flexible bags which are pre-sterilized. With the known method, the port of the bag is introduced into a filling room which is sterilized. After the filling of the bag, the port is sealed with a closure disc, so that an additional process step is required.

A device and a method for the filling of bottles, wherein only the bottle neck of the bottles is channeled into a clean room through which special atmosphere flows, are known from EP 1 514 835 A1.

There is known from EP 1 230 144 B1 a device and a method for the sterile filling of containers, wherein the containers are channeled into a clean room in which a closure station is located, which places closure caps, also referred to as sealing caps, onto the containers. The containers are then finally closed outside the clean room, there being applied onto the closure cap a closure element which can be a conventional screw-type closure.

EP 0 352 540 A2 describes a closure cap for dialyzers. Located inside the cap is a sealing element, which in a first position enables the flow-through of a sterilization liquid and in a second position seals the sterilized dialyzer hermetically. The known closure cap is intended for so-called in-line sterilization, wherein the sterilization takes place on the production line of the dialyzer. The closure cap is not intended for the filling of a container to be filled with a liquid filling and the closing of the same after the filling with the liquid filling, so that the liquid filling is packaged in a sterile fashion.

SUMMARY OF THE INVENTION

One problem underlying the present invention is to provide a closure for the filling and closing of containers containing medical liquids, said closure reducing the outlay on equipment and energy in the filling process by dispensing with the known methods of heat sterilization.

A further problem of the present invention consists in specifying a method with which the outlay on equipment and energy in the filling and closing of containers containing medical liquids is reduced by dispensing with the known methods of heat sterilization.

A further problem of the present invention is to make available a container with such a closure.

The closure according to the present invention for the filling and closing of containers containing medical liquids has a fixing piece and a connection piece, a closure body being formed between the fixing piece and the connection piece. The fixing piece, which has a passage, can be fitted to the container, and a connection part of a filling device can be connected to the connection piece, which also has a passage. The closure body has a recess connecting the passage of the fixing piece and the connection piece, so that the container can be filled with a medical liquid after the connection of the filling device to the connection piece.

The closure according to the present invention is distinguished by the fact that there is disposed in the recess of the closure body a closure piece, which is displaceable between a position freeing the passage of the fixing piece or the connection piece and a position closing the passage of the connection piece or fixing piece.

In a preferred embodiment, which is of particular importance, the closure has a removable protective cap.

The closure according to the present invention is to be understood in association with the method according to the present invention for the filling of a container with a medical liquid and the closing of the container. In the method according to the present invention, the at first still empty, but already sterilized container with the closure according to the present invention, which has a closure cap, is transferred into a clean room of a stipulated clean-room class. The container with the closure is preferably transferred into a clean room of clean-room class B. The protective cap of the closure closes the opening of the connection piece in a germ-tight fashion. Moreover, the passage of the connection piece or the fixing piece is not yet closed by the closure piece located in the closure body. The container with the closure is then channeled into a clean room which is of a clean-room class that is higher than the clean-room class of the first clean room, preferably into a clean room of clean-room class A. It is to advantage if not the whole container, but only its closure is located in the clean room with the higher clean-room class, preferably clean-room class A. The protective cap can be removed in the clean room of clean-room class B shortly before the channeling into the clean room of clean-room class A, as a result of which the opening of the connection piece is freed. The protective cap is preferably removed in the channeling section between the clean room of clean-room class B and the clean room of clean-room class A. In principle, however, it is also possible for the closure only to be removed in the clean room of class A. After connecting the connection part of the filling device to the connection piece of the closure, the container is filled with the medical liquid in the clean room of clean-room class A. After the filling of the container, the closure piece of the closure body is shifted into the position closing the passage of the fixing piece or connection piece, preferably by means of a pressing ram of the filling device traversable in the axial direction. The passage of the connection piece or fixing piece is thus sealed tight. Finally, the filled and sealed container is removed from the clean room.

The protective cap has the task of protecting the closure against contamination after the first sterilization process. The protective cap closes the opening of the closure, although the closure piece of the closure body frees the passage of the connection or fixing piece. Only shortly before the channeling into the clean room with the higher clean-room class is the opening of the closure freed by removal of the protective cap. The probability of contamination is thereby reduced to a minimum.

In a further preferred embodiment of the closure according to the present invention, the protective cap is placed onto the closure piece and the closure body in a lockable fashion. The protective cap can however also be held in a clamped fashion. The decisive factor is that the protective cap is secured on the closure in a captive manner. The closure cap preferably encloses only the connection piece and the closure body, so that the fixing piece is free.

In a further preferred embodiment, the closure piece is disposed in the recess of the closure body in a snap-in fashion in the position freeing the passage of the fixing piece or the connection piece. This ensures that the closure is open at the start of the filling process after removal of the protective cap. Instead of a snap-in connection of the closure piece and the closure body, the closure piece can also be inserted into the closure body in a clamped fashion.

A further preferred embodiment provides an axial guidance of the guide piece in the closure body. The closure piece preferably has a guide piece with openings, said guide piece being disposed displaceably in the recess of the closure body. The guide piece of the closure piece preferably has ribs disposed distributed around the periphery, the openings lying between the ribs.

The guide piece is pressed downwards by the pressing ram of the filling device in order to close the closure. In order that the pressing ram of the guide piece can gain a better grip, the guide piece preferably has a central recess for accommodating the pressing ram.

The closure piece of the closure body preferably has an essentially cylindrical valve piece with which the passage of the fixing piece can be closed. Alternatively, however, it is also possible to close the passage of the connection piece with the cylindrical valve piece.

A further preferred embodiment makes provision such that the connection piece and the closure body are configured as an essentially hollow-cylindrical body, into which the closure piece is inserted, whereas the fixing piece is preferably configured as an essentially tubular body, which can be fitted to the container.

In a particularly preferred embodiment, the connection piece, the closure body and the fixing piece are a one-piece injection-molded part, which can be produced cost-effectively in large numbers.

The closure according to the present invention is intended for the filling and closing of medical containers of the most varied design. The container can be a rigid container or a flexible bag. Moreover, it is possible to fix the closure according to the present invention to a syringe or an ampoule. It is thus possible to fill and to close the most diverse containers under aseptic conditions.

BRIEF DESCRIPTION OF THE DRAWINGS

Examples of embodiment of the present invention are explained in greater detail below by reference to the drawings.

In the Figures.

DETAILED DESCRIPTION OF THE DRAWINGS

Figure 1:
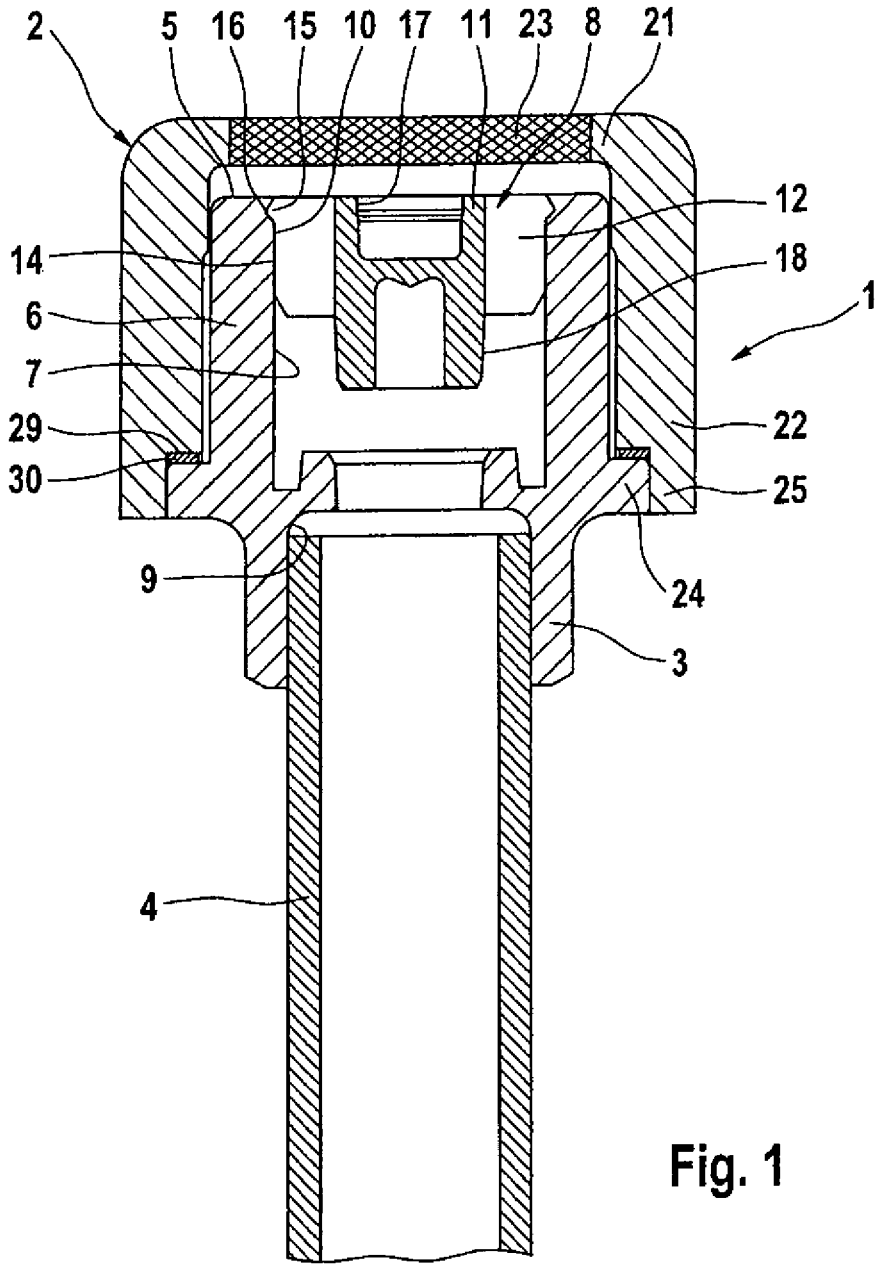
FIG. 1 shows an example of embodiment of the closure according to the present invention for the filling and closing of containers containing medical liquids in a sectional representation.
Figure 2:
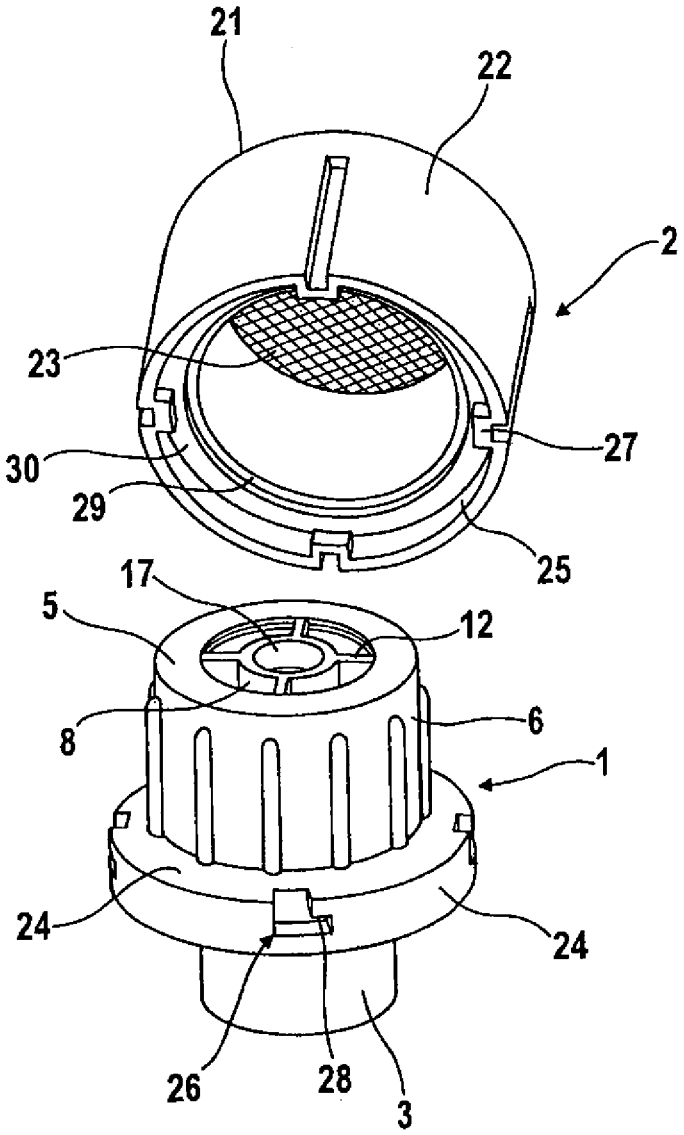
FIG. 2 shows a perspective representation of the closure from FIG. 1 with removed protective cap.

FIG. 1 shows an example of embodiment of the closure according to the present invention in a sectional representation with a placed-on protective cap, whilst FIG. 2 shows a perspective representation of the closure with a removed protective cap.

The closure according to the present invention comprises a closure part 1 and a protective cap 2, which sits on closure part 1. Closure part 1 comprises a hollow-cylindrical body 3, which serves as a fixing piece for fixing the closure on pipe connection 4 of a container (not shown in FIG. 1). Pipe connection 4 sits in cylindrical fixing piece 3, the two parts being glued or welded to one another. Apart from the fixing piece 3, the closure comprises a connection piece 5, which serves as the connection of a connection part of a filling device not shown in FIG. 1. The closure body 6 is formed between fixing piece 3 and connection piece 5. Connection piece 5 and closure body 6 are an essentially hollow-cylindrical body which has a larger internal and external diameter than the essentially tubular body of fixing piece 3. Connection piece 5 and closure body 6 are produced together with fixing piece 3 as a one-piece injection-molded part.

Closure piece 8 sits in recess 7 of closure body 6, said closure piece being displaceable in recess 7 between a position freeing passage 9 of fixing piece 3 and a position closing the passage 9 of the fixing piece 3. FIG. 1 shows the closure with the closure piece in the open position, passage 10 of connection piece 5 being connected via recess 7 of the closure body to passage 9 of fixing piece 3. In the open position, closure piece 8 is fixed in a snap-in fashion.

Figure 3:
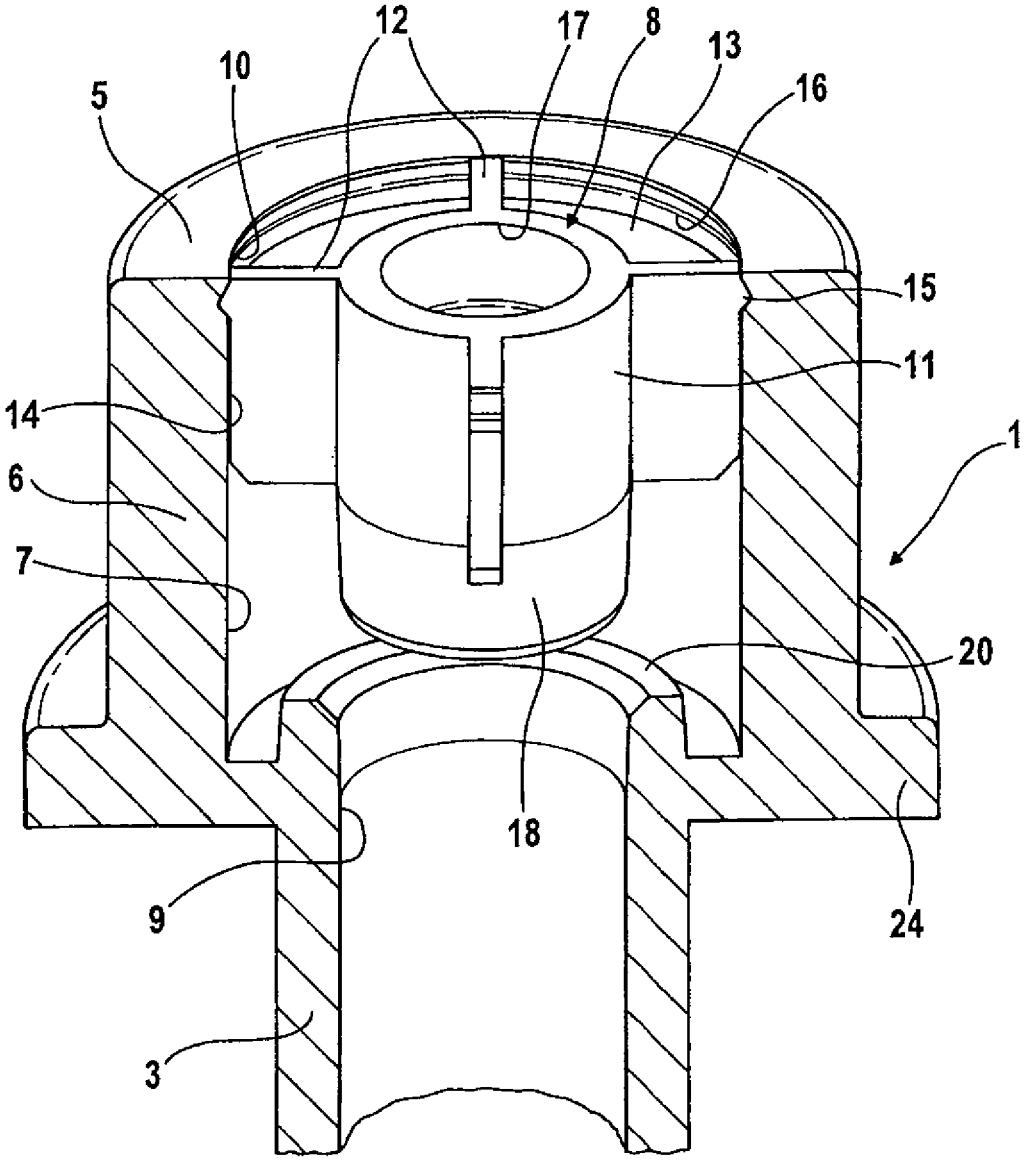
FIG. 3 shows a section through the closure from FIG. 1 in a perspective representation with removed protective cap, the closure being opened.

Closure piece 8 has a guide piece 11 with openings 13, from which four ribs 12 disposed around the periphery at identical intervals project radially, and the end faces of the ribs lie adjacent to wall 14 of closure body 6 (FIG. 3). Ribs 12 each have a shoulder 15 projecting outwards, which engages in a snap-in fashion in a peripheral groove 16 in the wall of closure body 6.

Guide piece 11 of closure piece 8 has at the upper side a central cylindrical recess 17 for accommodating a pressing ram (not shown) of the filling device. Guide piece 11 also has an essentially cylindrical, preferably hollow-cylindrical valve piece 18, with which passage 9 of fixing piece 3 can be closed.

For the closing of the closure, guide piece 11 is pressed downwards by means of a pressing ram (not shown) into the recess of the closure body. The snap-in connection of the valve piece in the valve body is thus released.

Figure 4:
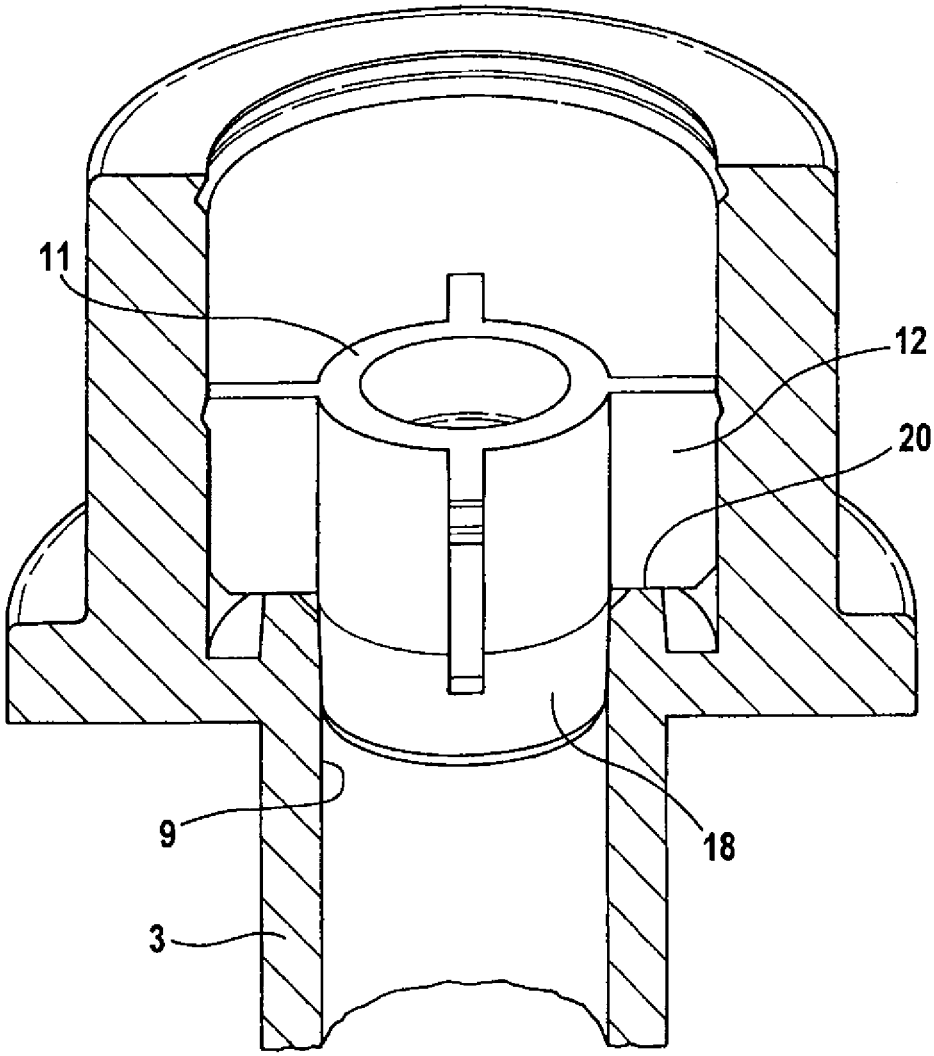
FIG. 4 shows a section through the closure from FIG. 1 in a perspective representation with removed protective cap, the closure being closed.

FIG. 4 shows the closed closure, valve piece 18 of closure piece 8 sitting in passage 9 of fixing piece 3. When the closure is closed, ribs 12 lie on a projecting shoulder 20, which extends around passage 9 of fixing piece 3. Valve piece 18 sits in a sealing fashion in the passage of fixing piece 3. Both parts are preferably configured conical.

Protective cap 2 of the closure shown in FIG. 2 comprises a lid part 21 and a rim part 22, which surrounds connection piece 5 and closure body 6 when the protective cap sits on closure part 1. A sterile membrane 23 is inserted into lid part 21 of protective cap 2. Lower rim 25 of rim part 22 provides a seal with respect to a projecting shoulder 24 which surrounds closure part 1. Formed at the inner side of lower rim 25 of rim part 22 of protective cap 2 is a shoulder 29, on which a sealing ring 30 is fixed, which seals protective cap 2 with respect to the upper side of projecting rim 24 of closure part 1.

Protective cap 2 and closure part 1 can be connected to one another with a bayonet connection 26, which comprises locking elements 27 projecting inwards from lower rim 25 of rim part 22, said locking elements engaging in undercut grooves 28 at the outer side of outwardly projecting rim 24 of closure part 1.

The method according to the present invention for the filling of a container with a medical liquid and for closing the container is described in detail below by reference to FIGS. 5A to 5D. FIGS. 5A to 5D show the closure together with a part of pipe connection 4 of the container. The initially still unfilled container is as such not represented in the figures.

The container with the closure is fed to a filling station in which the following process steps are carried out.

The container with the closure according to the present invention is first channeled into a clean room of clean-room class B. Protective cap 2 is still located on closure part 1 of the closure in the clean room of class B. The closure is therefore sealed germ-tight, having been sterilized together with the container in a preceding sterilization process. In the case of heat sterilization, a sterile membrane 23 is provided in lid part 21 of protective cap 2 of the closure, the membrane sealing the closure germ-tight after the sterilization, but being permeable to water vapor or gas during the sterilization.

The closure is then channeled from the clean room of class B into a clean room of class A, which is surrounded by clean room B. It is not necessary for the whole container with the closure to be channeled into a clean room of class A. The decisive factor is that the closure of the container is located in the clean room.

The threshold values for microbial contaminations and for the permitted particle concentrations are stipulated according to the EC Guide to Good Manufacturing Practice for the clean rooms of class A and B. These threshold values are known to the person skilled in the art. The specification with which the one or other clean room complies is in principle unimportant. The decisive factor is that the clean room in which the filling takes place is polluted with germs and/or particles to such a small extent that an aseptic filling is possible.

Figure 5A:
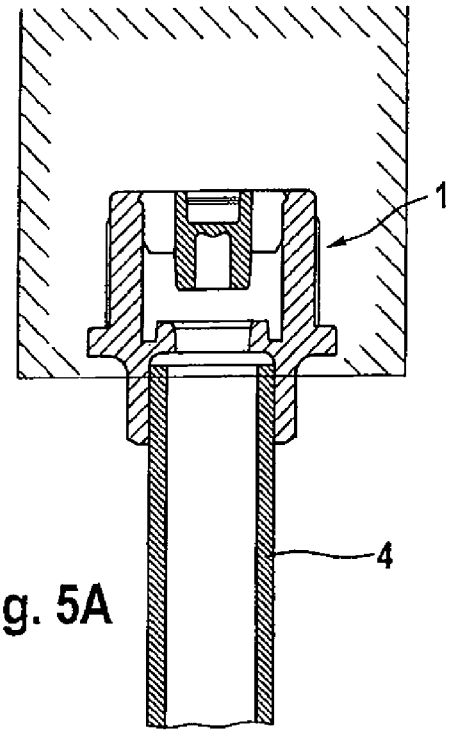
FIGS. 5A-5D show the individual process steps for the filling and closing of a container with the closure according to the present invention.
Figure 5B:
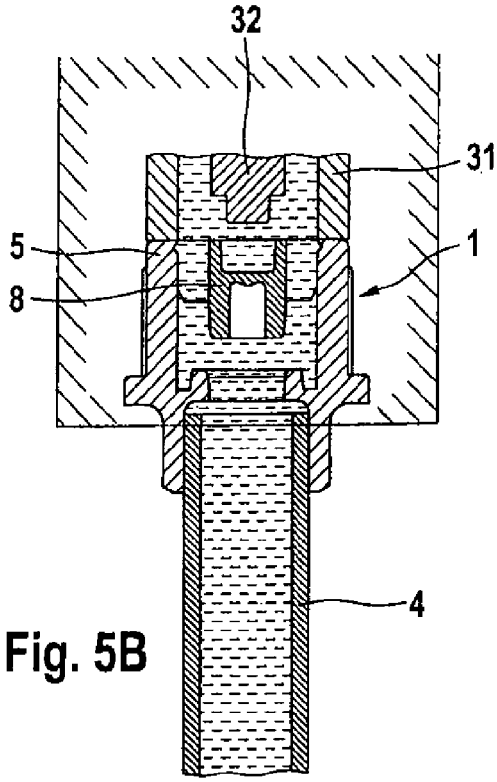

In the clean room of clean-room class B, protective cap 2 is removed from closure part 1 of the closure shortly before the transfer into clean room of clean-room class A. The protective cap is preferably removed in the channeling section between the clean room of clean-room class B and the clean room of clean-room class A. At this time, the closure is still open (FIG. 5A). The bag is now filled in the clean room of class A. The filling of the bag takes place by means of a filling device, whereof only the main components are represented. The filling device comprises a filling tube 31, whose external diameter and internal diameter correspond respectively to the external and internal diameter of connection piece 5 of closure part 1 of the closure. Filling tube 31 of the filling device is traversed in the vertical direction until its end face lies adjacent to the end face of connection piece 5 of closure part 1. The two parts thereby form a seal against one another at the end faces. During filling, the medical liquid flows through the open closure and pipe connection 4 into the container (not shown) (FIG. 5B).

Figure 5C:
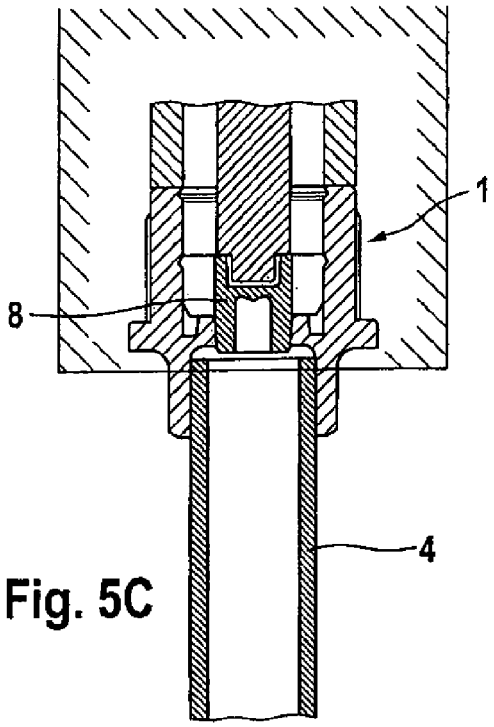

Located in filling tube 31 of the filling device is a pressing ram 32, which can likewise be traversed in the vertical direction. Pressing ram 32 is traversed downwards in order to close the closure. The pressing ram thereby presses closure piece 8 downwards out of the snap-in position, so that the closure piece closes the closure (FIG. 5C).

Figure 5D:
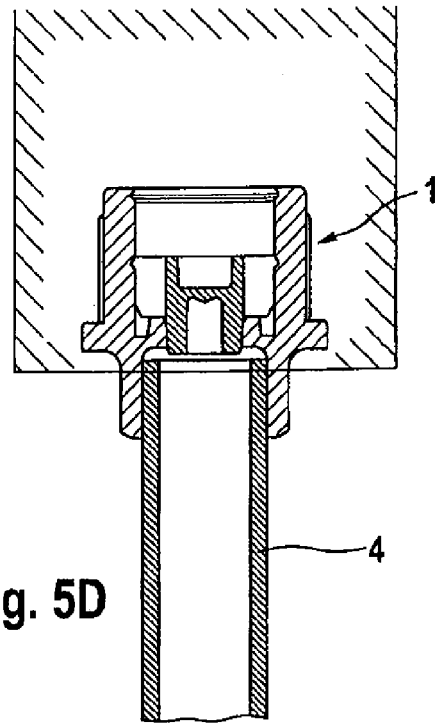

Filling tube 31 is then traversed back upwards again by means of pressing ram 32 (FIG. 5D). After the tight closing of the closure, the closure is channeled out of the clean room of class A back into the clean room of class B.

For the purpose of gripping the closure when the closures are channeled into and out of the clean rooms, tools not shown in FIGS. 5A to 5D, for example holding jaws or suchlike, are provided, which are known to the person skilled in the art. Protective cap 2 protects closure part 1 of the closure, in particular the region of the opening above the closure piece, against contamination after the preceding heat sterilization. Since the protective cap is removed in a clean room of class B shortly before entry into a clean room of class A solely for the actual filling process before the closing of the closure, the probability of contamination is reduced to a minimum.

Figure 6:
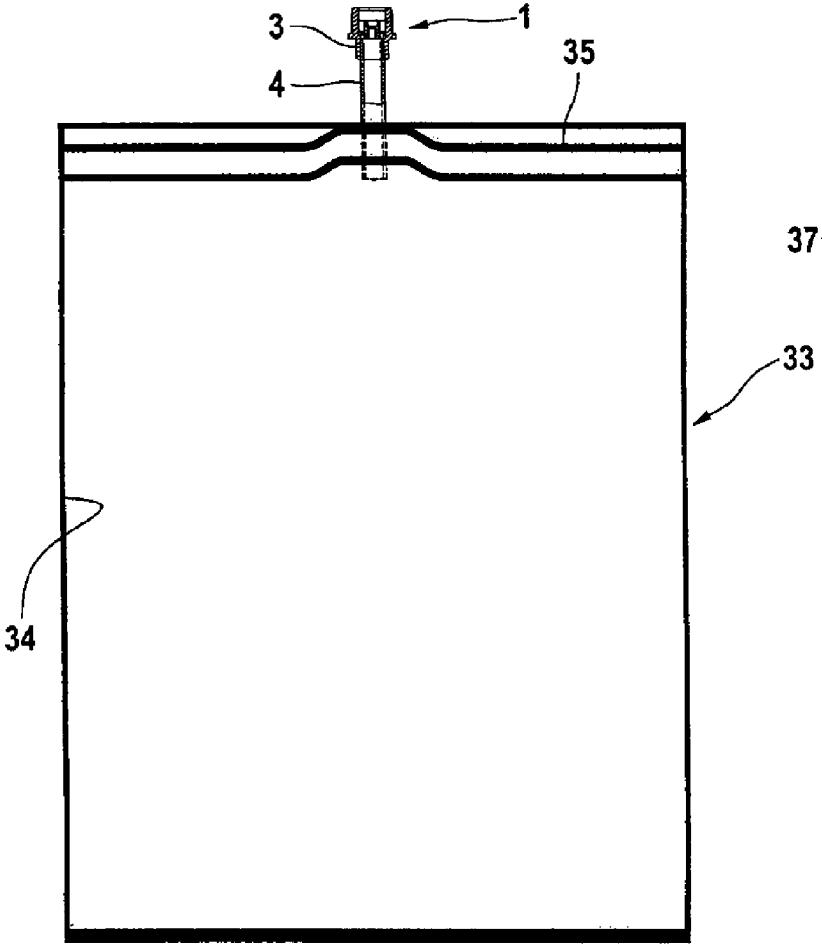
FIG. 6 shows a bag according to the present invention with the closure according to the present invention.

FIG. 6 shows an example of embodiment of a container according to the present invention with the closure according to the present invention. The container is a bag 33, in particular for receiving an enteral nutritive solution, a parenteral nutritive solution, a dialyzing fluid or an infusion solution, said bag being produced from a film tube 34 or two films lying one upon the other, which are welded together at the edges. Welded into upper weld seam 35 is pipe connection 4, which is connected, for example glued or welded, to fixing piece 3 of closure part 1.

Figure 7:
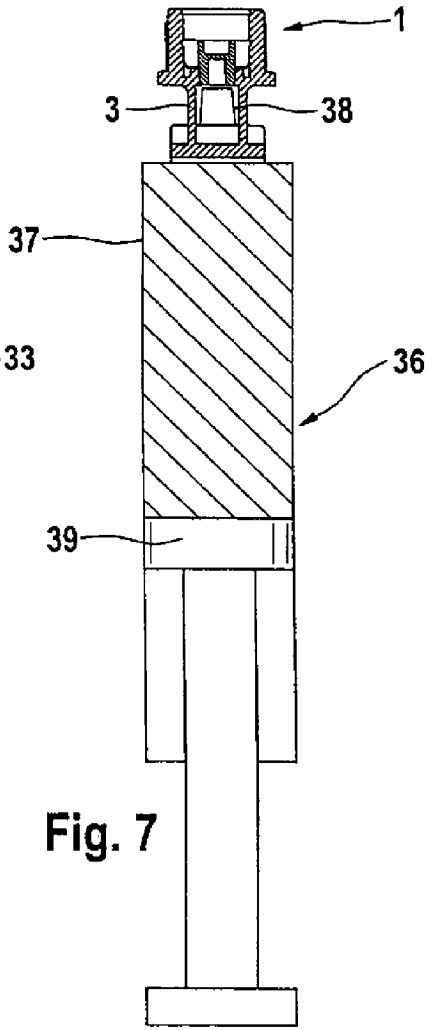
FIG. 7 shows a syringe according to the present invention with the closure according to the present invention.

FIG. 7 shows a further example embodiment of a container with the closure. This container is a syringe 36, which comprises a syringe cylinder 37 with a cone 38, in particular a Luer cone, and a plunger 39. The closure according to the present invention is fixed to cylinder 37, cone 38 extending into fixing piece 3 of closure part 1.

Figure 8:
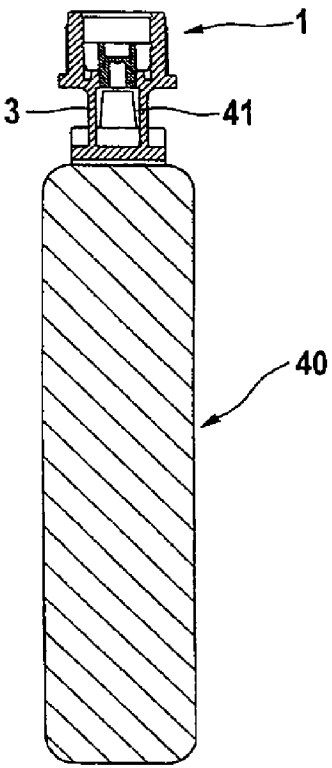
FIG. 8 shows an ampoule according to the present invention with the closure according to the present invention.

FIG. 8 shows an ampoule 40 as a container, which likewise has a cone 41, in particular a Luer cone. The closure according to the present invention is fixed to the ampoule, cone 41 again extending into fixing piece 3 of closure part 1.

The invention claimed is:

1. A closure for the filling and closing of containers containing medical liquids comprising:

a fixing piece with a first passage, wherein said fixing piece can be fitted to a container;

a connection piece with a second passage, wherein a connection part of a filling device can be connected to the connection piece;

a closure body that has a recess, said closure body located between the fixing piece and the connection piece, said closure body connecting the first passage and the second passage, so that the container can be filled with a medical liquid when the filling device is connected to the connection piece; and a closure piece disposed in the recess of the closure body, said closure piece being displaceable in the recess between a first position opening the first passage and the second passage, and a second position closing the first passage and the second passage, wherein the closure piece comprises a central recess for accommodating a pressing ram therein.

2. The closure according to claim 1, further comprising a removable protective cap.

3. The closure according to claim 2, wherein the protective cap is configured to be locked onto the connection piece and the closure body.

4. The closure according to claim 2, wherein the protective cap comprises:

a lid part covering the connection piece; and a rim part that surrounds the connection piece and the closure body.

5. The closure according to claim 1, wherein the closure piece is disposed in the recess of the closure body, said closure piece further comprising a shoulder for engaging a peripheral groove on the inner wall of the closure body in a snap-in fashion in the first position.

6. The closure according to claim 1, wherein the closure piece further comprises a guide piece having radially-extending ribs distributed around a periphery of the central recess of the closure piece and openings therebetween.

7. The closure according to claim 1, wherein the closure piece further comprises an essentially cylindrical valve piece adapted to fit within the first passage, with which the first passage can be closed.

8. The closure according to claim 1, wherein the connection piece and the closure body are configured as an essentially hollow-cylindrical body, into which the closure piece is received.

9. The closure according to claim 1, wherein the fixing piece is configured as an essentially tubular body.

10. The closure according to claim 1, wherein the connection piece, the closure body and the fixing piece are a one-piece injection-molded part.

11. A container for receiving a medical liquid with a closure according to claim 1.

12. The container according to claim 11, wherein the container is a bag with a pipe connection, to which the fixing piece of the closure is fixed.

13. The container according to claim 11, wherein the container is a syringe, to which the fixing piece of the closure is fixed.

14. The container according to claim 11, wherein the container is an ampoule, to which the fixing piece of the closure is fixed.

15. The closure according to claim 2, wherein the closure piece cannot be moved to the first position when the cap is attached.

16. The closure according to claim 6, wherein the radially-extending ribs have end faces that lie adjacent an inner wall of the closure body.

* * * * *